United States Patent [19]

Gazarek

[11] 4,066,305

[45] Jan. 3, 1978

[54] MODULAR ELECTRONIC DESK

[75] Inventor: Kenneth F. Gazarek, Warrenville, Ill.

[73] Assignee: Equipto Electronics Corporation, Aurora, Ill.

[21] Appl. No.: 712,753

[22] Filed: Aug. 9, 1976

[51] Int. Cl.[2] ..... A47B 17/00

[52] U.S. Cl. ..... 312/195; 312/223; 312/257 SK

[58] Field of Search ..... 312/108, 195, 223, 257 R, 312/257 SK, 257 A

[56] References Cited

U.S. PATENT DOCUMENTS

| | | | |
|---|---|---|---|
| 2,831,745 | 4/1958 | Parmet | 312/257 SK |
| 3,125,387 | 3/1964 | Abrahamson | 312/195 |
| 3,306,692 | 2/1967 | Timmerman | 312/257 R X |
| 3,586,409 | 6/1971 | Cisler | 312/195 X |
| 3,857,622 | 12/1974 | Mohr et al. | 312/195 X |
| 3,871,726 | 3/1975 | Stegner | 312/195 |
| 3,883,202 | 5/1975 | Konig | 312/223 |
| 3,922,045 | 11/1975 | Meyer | 312/195 X |

FOREIGN PATENT DOCUMENTS

| | | | |
|---|---|---|---|
| 2,134,442 | 2/1973 | Germany | 312/195 |
| 1,095,467 | 12/1967 | United Kingdom | 312/195 |

*Primary Examiner*—Paul R. Gilliam
*Assistant Examiner*—David H. Corbin
*Attorney, Agent, or Firm*—Hill, Gross, Simpson, Van Santen, Steadman, Chiara & Simpson

[57] ABSTRACT

A modular desk especially suitable to serve as a work station for electronic equipment, has a load supporting top structure comprising a frame unit of substantial length and width and provided with structural members for supporting a relatively thin generally horizontal working area top panel firmly against sagging under load, and opposite ends of the top structure are secured to and supported in stable relation on standards one or both of which are desirably hollow providing storage chambers accessible through openable closures. One or more compartment modules having accessibility closures may be supported on and under the top structure in a manner to contribute to stability of the assembly.

15 Claims, 5 Drawing Figures

10
11
12
13
14
15
17
18
19
20
21
22
23
24
25
27
28
29
42
44
47
48
48a
49
50
51
52
53
69
70
71
72
73
77
78
79
80
84
85
87
88
89
90
91

Fig. 4
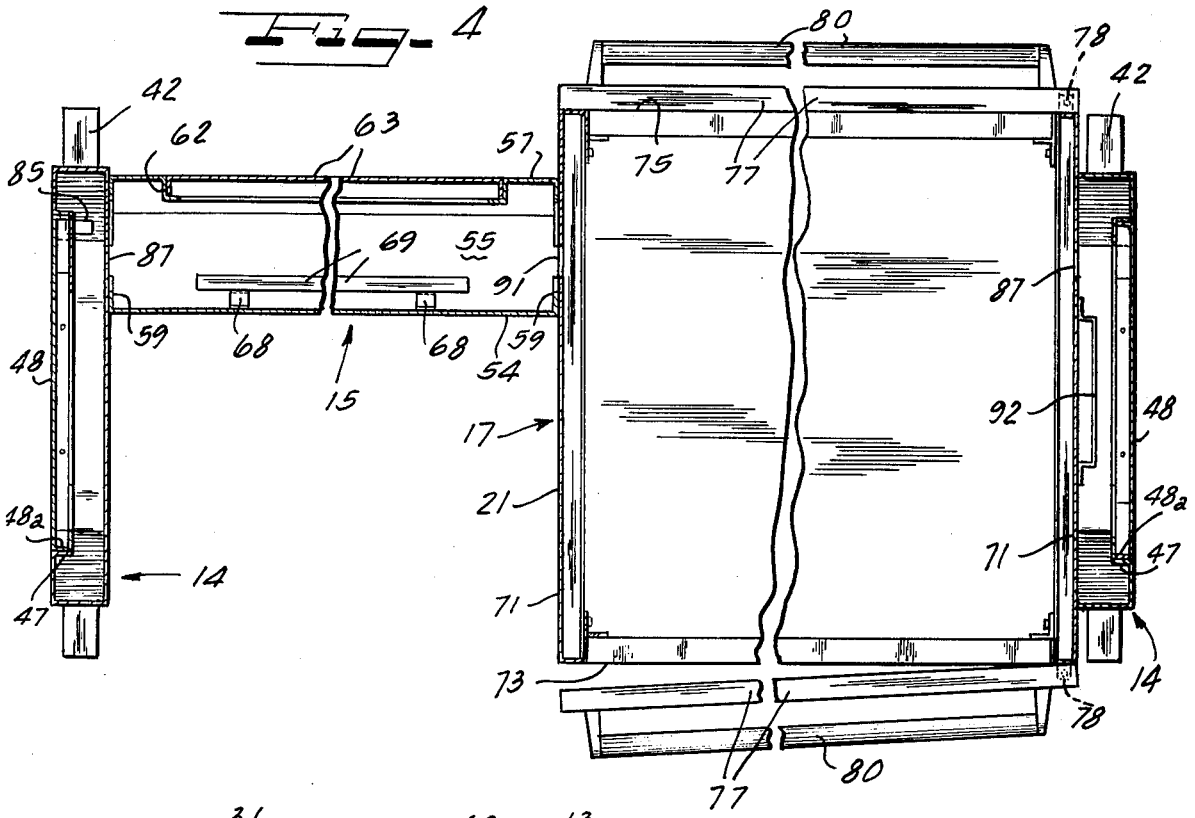
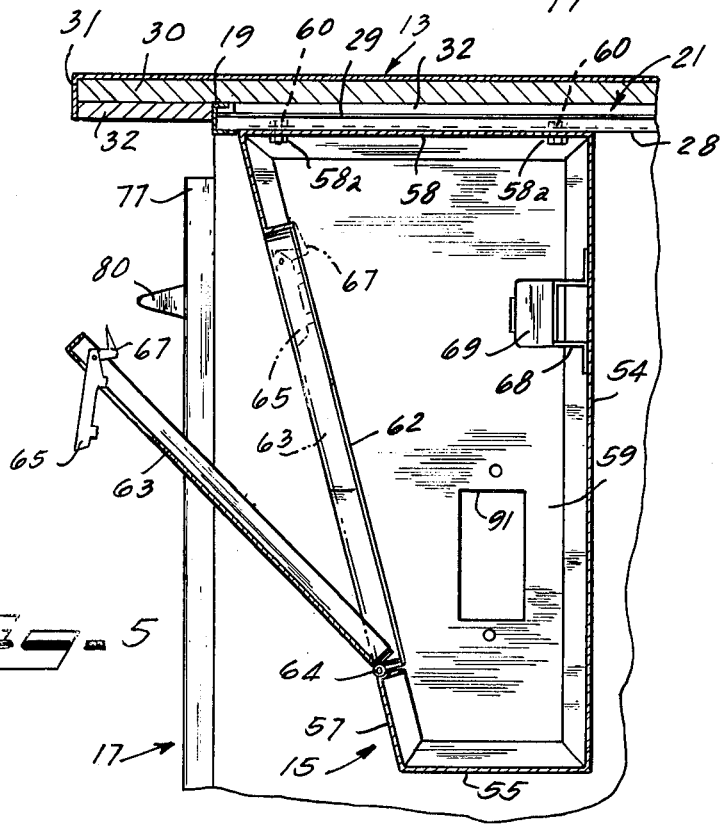
Fig. 5

MODULAR ELECTRONIC DESK

This invention relates to modular desk construction, and is more particularly concerned with desks adapted to serve as work stations for electronic equipment.

A variety of electronic equipment, including computers, data processors, calculators, controllers and similar intruments and machines useful in record producing and keeping, storage and retrieval, and the like are widely used in commerce and industry. Much of such equipment is of such compact construction that a number of different or related instruments can be accommodated conveniently on a desk at which a person can conveniently sit while using the equipment.

Numerous and varied desks, stands and tables have been provided heretofore for such equipment, but have suffered from various deficiencies and problems which it has been the aim of the present invention to overcome. For example, electronic equipment requires electric power connections, and the necessary cables for this purpose have generally been exposed where not only are they unsightly but also sometimes may be undesirable obstructions, and a hinderence to freedom of movement in premises maintenance and cleaning, especially where a plurality of instrumentalities are carried by one desk. Exposed electrical connectors present obvious hazards.

Some instruments accommodated by a desk of this type while they may be fairly compact are, because of the electronic gear and the associated mechanisms of considerable weight. In at least some prior desks there has been a problem of the desk top sagging under equipment load, especially where the top is of a size to accommodate a plurality of instruments.

Another problem encountered with prior desks of this type is that they have inadequate storage space for manuals, spare parts, service tools, and the like.

Prior desk constructions have also often lacked versatility in their design.

An important object of the present invention is to provide a new and improved modular desk construction which will overcome the disadvantages, deficiencies, inefficiencies, shortcomings and problems in prior desks of this type.

An important object of the invention is to provide a new and improved modular desk construction especially suitable for electronic equipment.

Another object of the invention is to provide a new and improved modular desk construction having a novel load supporting top structure.

A further object of the invention is to provide a new and improved modular desk construction having novel compartment modular structure.

Still another object of the invention is to provide a new and improved modular desk construction having novel standard structure.

Yet another object of the invention is to provide a new and improved modular desk construction possessed of substantial flexibility as to module proportions and arrangement.

According to features of the invention there is provided a modular desk construction comprising a load supporting top structure comprising a frame unit of substantial length and width and having structural members for supporting a relatively thin generally horizontal working area top panel firmly against sagging under load, standards for upright disposition in supporting relation under each end portion of the frame unit, and means for securing the end portions of the frame unit in stable spanning relation on top of the standards.

According to other features of the invention there is provided a modular desk construction comprising a load supporting top structure, standards for spaced apart upright disposition in supporting relation under the top structure, a compartment module for suspension from the top structure between the standards, means for securing the compartment module to the top structure and to at least one of the standards, the compartment module having an access opening, and an openable closure for the access opening.

According to further features of the invention, there is provided a modular desk construction comprising a load supporting top structure, standards for spaced apart upright disposition in supporting relation under the top structure, at least one of the standards being hollow whereby to provide a substantial chamber therein and having an opening into the chamber, and an openable closure for the opening.

Other objects, features and advantages of the invention will be readily apparent from the following description of a representative embodiment thereof, taken in conjunction with the accompanying drawings although variations and modifications may be effected without departing from the spirit and scope of the novel concepts embodied in the disclosure, and in which:

FIG. 4 is a fragmental horizontal sectional detail view taken substantially along the line IV—IV of FIG. 3; and FIG. 5 is a vertical sectional detail view taken substantially along the line V—V of FIG. 3.

A modular electronic desk construction 10 embodying features of the invention is especially adapted to provide a work station for convenience in utilizing various and sundry electronic equipment such as may be useful in calculating, data processing, storage and retrieval, communications, and the like. By way of example, two representative types of electronic equipment units 11 are depicted as carried on top of the table in FIG. 1. It will be understood, of course that various and sundry other electronic units larger or smaller than those depicted may be accommodated on the desk, as desired.

Figures 1, 2:
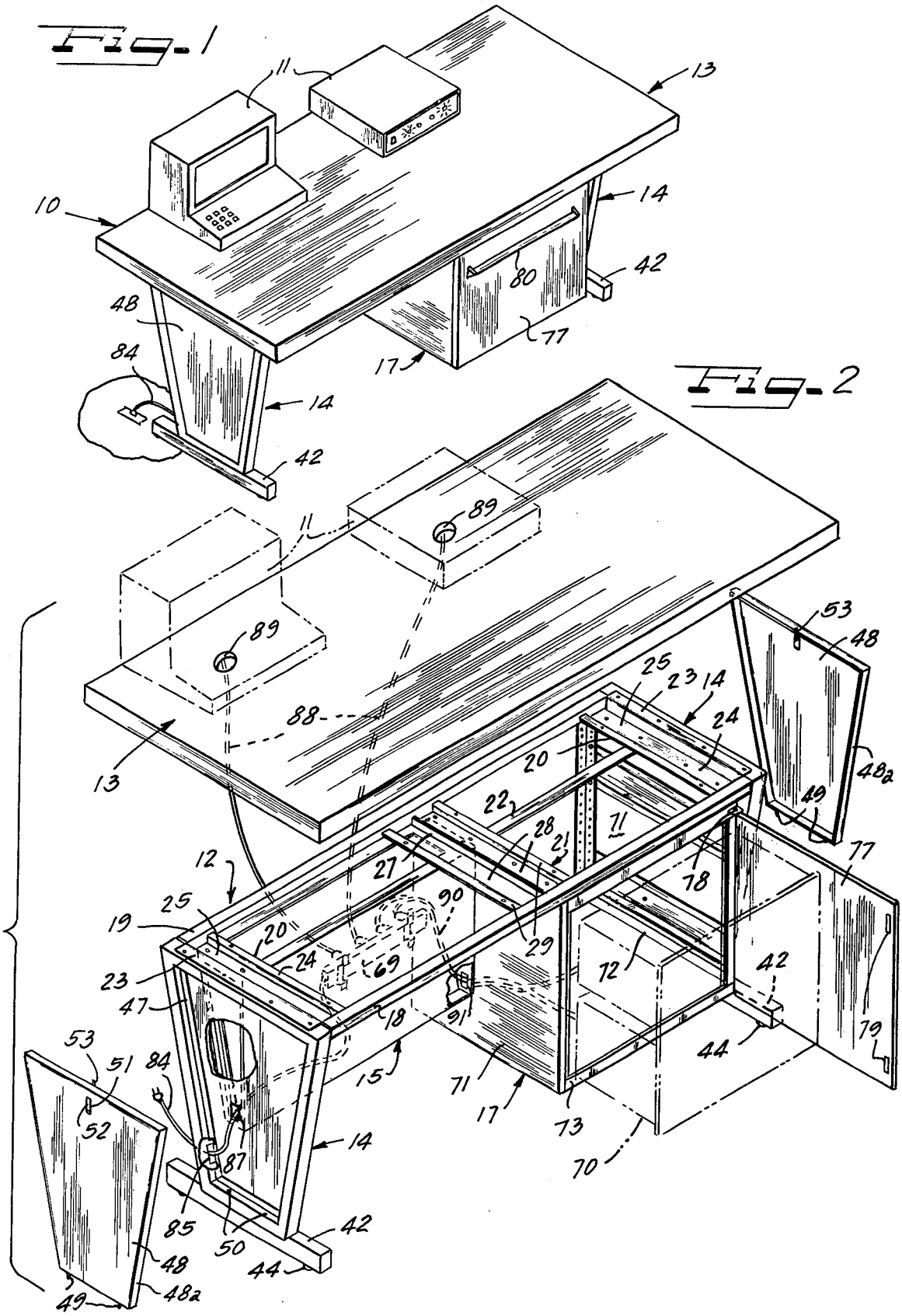
FIG. 1 is an isometric view of a modular desk embodying features of the invention.
FIG. 2 is an exploded assembly view of the desk.

As best seen in FIGS. 1 and 2, the desk 10 comprises an assembly of module units which are prefabricated and then connected together, lending the assembly to packing and shipment in knockdown condition to the point of use where the desk can be put together in the desired location. To this end, the desk 10 comprises as principal modular components a load supporting top structure comprising a frame unit of substantial length and width for supporting a relatively thin generally horizontal working area top panel 13 firmly against sagging under load. End pylons or standards 14 are provided for upright disposition in supporting relation under each end portion of the frame unit 12. Although for some purposes the desk may be used with just the top structure and the supporting standards, for most purposes it will be desirable to provide the desk with one or more compartment modules there being represented in the drawings two such modules including a combination modesty panel and cable compartment module 15 and an electronic chassis compartment module 17. These modules are mounted in suspended relation under the top structure frame 12 and are desirably so related to the top structure frame 12 and the standards 14 and to one another as to improve the stability of the desk for heavy electronic equipment load. By preference the several modular components of the desk 10, except the top 13, are made from as lightweight metal as practicable. For example, most of the structural elements of the modules may be constructed from on the order of 16 gauge sheet steel. Where preferred, of course, aluminum sheet or extrusions may be utilized.

In a preferred construction, the top frame 12 comprises an assembly of rigidly welded bars comprising a longitudinal front bar 18, a corresponding longitudnally extending rear bar 19, preferably identical transverse end connecting bars 20 at each opposite end of the frame, and where necessary one or more transverse intermediate bars 21. All of the bars 18, 19, 20 and 21 are preferably formed up in angular, rigid cross section from sheet metal. A longitudinally extending tie and reinforcing bar 22 of flat section may extend across the bottom surfaces of the end bars 20 and the intermediate bar 21 and be welded thereto. The front and rear bars 18 and 19 have their opposite ends interengaged with the respective ends of the transverse end bars 20 and welded thereto. Each of the front and rear longitudinal bars 18 and 19 has an upper desk top supporting surface in a common plane with the other longitudinal bar. Each of the end bars 20 is preferably of a generally stepped structure providing an outwardly projecting downwardly facing seat flange 23 for supporting the frame 12 on the respective associated standard 14, and an inwardly extending table top attachment flange 24. Both of the flanges 23 and 24 are at a slightly lower elevational than the upper surface top panel supporting surfaces of the bars 18 and 19. Stepped below the flanges 23 and 24 of each of the bars 20 is a downwardly facing supporting intermediate body portion 25. Although the bar 21 may be formed in one piece, it may for rigidity be formed up from two pieces of sheet metal secured together as by means of welding along abutting narrow upstanding reinforcing flanges 27 between downwardly facing suspension supporting body portions 28 lying in a plane with the bar body portions 25. Along opposite edges of the composite bar 21 upwardly stepped laterally extending and upwardly facing desk top panel supporting flanges 29 lie in a common plane with the end bar flanges 24.

Figure 3:
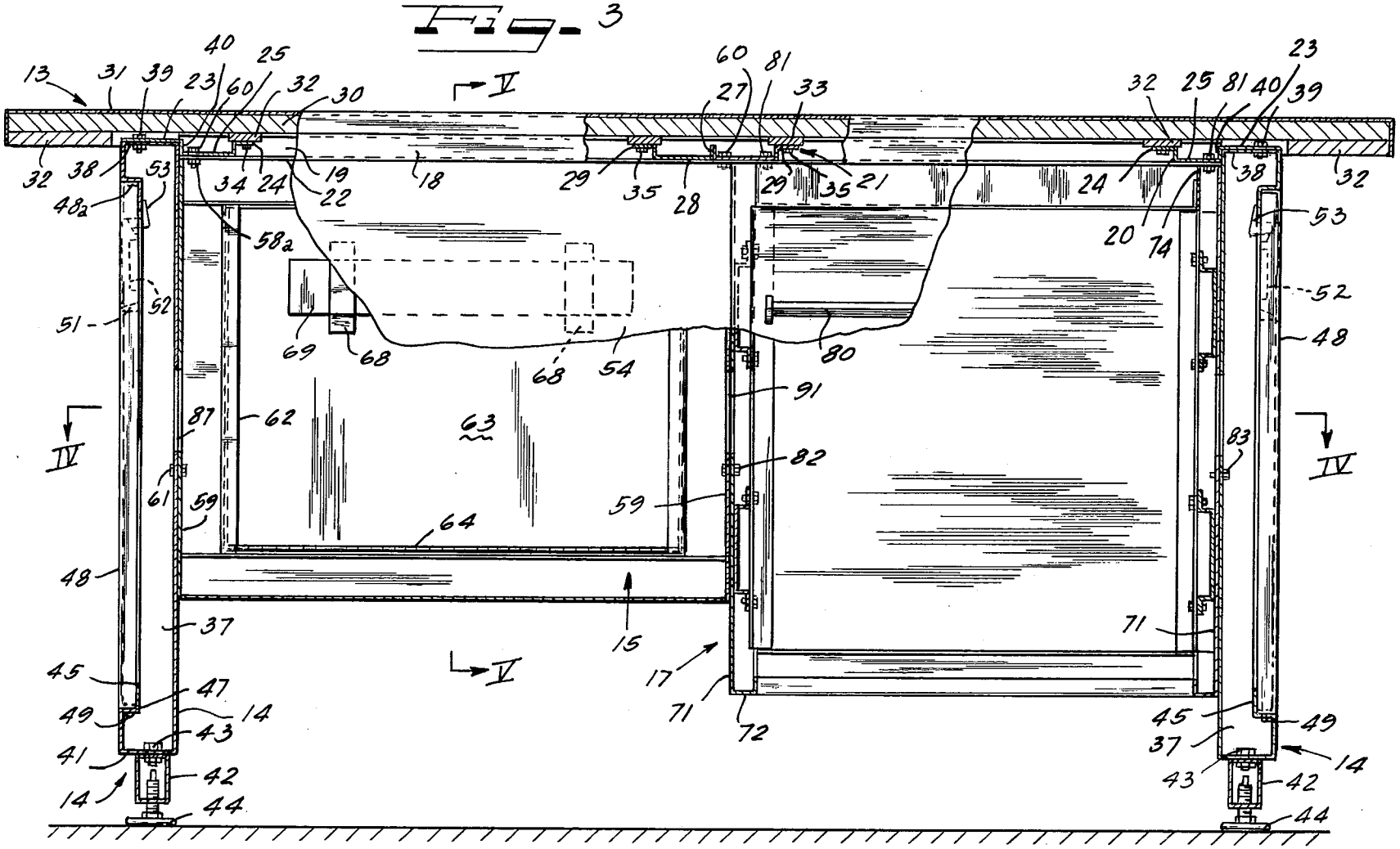
FIG. 3 is a front elevational view partially in section of the desk.

In a preferred construction the table top 13 comprises a suitable panel body 30 (FIG. 3) of relatively lightweigth material such as pressboard with a hard wear surface 31 such as Formica. In length and width, the top 13 may be suitably longer and wider than the frame unit 12 and the edges of the top are desirably skirted by the same wear surfacing material 31 as the upper working surface of the top. Along the opposite edge overhanging portions of the top 13 longitudnally and transversely extending reinforcing strips 32 may be provided and which may comprise wood. Support of the panel body 30 is directly on the top surfaces of the bars 18 and 19 preferably throughout the length of such bars. Transverse support is provided under the end and central portions of the table top by the coplanar transverse flanges 24 and 29, the underside of the top panel body 30 being provided with fixedly secured transverse attachment and support bars 32 which rest upon the flanges 24, and a transverse intermediate support bar 33 which rests upon the flanges 29. The pad, or cleatlike support bars 32 and 33 may be in the form of suitable wooden strips secured in any suitable manner such as by adhesive or mechanical means to the underside of the top panel body 30. Attachment of the top panel 13 to the frame unit 12 is preferably by means of screws 34 by which the panel is secured through the bars 32 to the flanges 24. Similarly attachment to the flanges 29 is by means of screws 35.

Each of the standards 14 is desirably constructed substantially according to a common pattern. For this purpose each of the standards is formed from suitable gauge sheet metal, providing a substantial hollow chaber 37 therein. In a desirable form, each of the standards 14 may be of a suitable geometric form, such generally keystone trapezoidal outline, providing an upper end head 38 of a length preferably substantially equal to the distance between the outer sides of the frame bars 18 and 19. The width of the standard-engaging top frame flanges 23 is preferably about the same as the top width of the standards 14 and rests upon the perspective standard heads 38, being fixedly but detachably secured thereto as by neans of suitable screws 39. For stability the upper inside corner of each of the standard heads 38 is received in a rabbet groove shoulder 40 provided by the configuration of the associated frame bar 20 between the body portion 25 thereto and the flange 23.

Along a base portion 41 of each of the standards 14 suitable stable supporting means are provided comprising respective rigid foot bars 42 secured to the base ends 41 as by means of screws 43. Suitable caster means such as levelers 44 are desirably carried by the lower sides of the bars 42. If preferred, the levelers 44 may be replaced by rolling casters.

At their outer faces, the hollow chambers standards 14 are provided with respective access openings 45 defined by suitable reinforcing and inset seating flange structure 47 in which is adapted to be received a complementary closure panel 48 provided with an inturned reinforcing flange structure **48*a*. For releasably retaining the closure 48 in place on its standard 14, the lower edge of the closure is provided with means comprising a pair of spaced downwardly projecting retaining pins 49 which are receivable in complementary socket holes 50 in the lower portion of the reinforcing inset flange 47. Within a recess 51 in the face of the panel 48 adjacent to its upper edge, there is mounted a pivoted latch 52 which is adapted to be manipulated out of the recess 51 for releasing the closure panel and which has a latch finger 53 engageable behind the opening defining flange 47 in the retained chamber closing position of the closure panel 48**.

Although there may be just a modesty panel across the back of a knee space under the desk top, in the preferred construction the combination modesty panel and compartment module 15 is employed. As best observed in FIGS. 3, 4 and 5, the module 15 comprises a hollow structural unit formed up from sheet metal and secured into a rigid unit as by means of welding to provide a generally vertical front wall 54, a bottom wall 55, a rear wall 57, an at least partially open top wall 58 and respective opposite side walls 59. At suitable intervals, the top wall 58 is perforated and provided on its under side with means comprising welded-on nuts **58*a*. Thereby the compartment module 15 is adapted to be secured in suspended relation to and under the top frame 12 as by means of screws 60 which fasten the top wall 58 to the body portion 25 of one of the side bars 20** and to the body 28 of the intermediate bar 21. In addition, by having one of the side walls 59 in face-to-face relation to the inner face of the adjacent standard 14, greater stability can be attained in the desk by securing such wall 59 to the standard as by means of one or more screws 61.

To gain access into the chamber within the compartment module 15, one wall thereof, preferably the rear wall 57, is provided with an access opening defined by a stepped seating flange 62 adapted to receive a complementary closure or door panel 63 in closing relation. In a preferred arrangement, the door panel 63 is attached as by means of a piano hinge 64 along the bottom extent of the seating flange 62 so that the door can be swung open rearwardly and downwardly as indicated in FIG. 5. In the closed position of the door, a pivoted handle latch 65, which may be of the same type as the latch 52 is manipulated to engage a latching finger 67 with the turned flange defining the upper edge of the access opening, as indicated in dash outline in FIG. 5. Within the compartment provided by the compartment module 15 suitable support bracket means 68 are desirably provided to support one or more electrical outlets 69 which may be individual or on a suitable outlet bar. The support means 68 may be formed up from sheet metal and welded on the inside of the front wall 54.

Although, if preferred, the cable concealing compartment module 15 may be used by itself in association with the desk 10, the compartment module 17 is desirably mounted in association with the table in addition to the compartment module 15 for supporting means such as a data console 70 the chassis of which is indicated in phantom outline in FIG. 2. For this purpose, the compartment module 17 comprises a generally cubical hollow structure suitable formed up from sheet metal components welded into a solid unit, comprising opposite side walls 71, a bottom frame 72, a front frame 73, a top frame 74 and a rear frame 75 (FIG.4). Suitable console supporting means may be mounted on and between the side walls 71. In a preferred construction, both the front and rear of the compartment module 71 are provided with respective closures in the form of doors 77 mounted at one side of the respective front and rear openings by means of hinges 78 whereby the doors can be swung completely open as shown in FIG. 2 and can be swung into closed position wherein suitable latch means such as magnetic latches 79 will retain the doors closed until pulled open with the aid of respective handles 80 mounted on the outer sides of the doors.

In mounting the compartment module 17 on the desk 10, the upper frame 74 is secured as by means of screws 81 to the body 25 of the associated end top frame bar 20 and the body 28 of the intermediate frame bar 21. Thereby the load of the compartment module 17 and console housed therein is supported in suspended relation under the top frame unit 12. By having the module 17 and the module 15 integrated as to width between the standards 14, efficient utilization of the space under the desk top is attained, and both of the modules 15 and 17 are utilized to stabilize the entire desk assembly. For this purpose the inner of the side walls 71 of the module 17 desirably abuts the inner of the side walls 59 of the module 15 and is desirably fastened thereto as by means of one or more screws 82. Additionally, the outer of the side walls 71 is desirably secured in abutment with the inner face of the adjacent standard 14 as by means of one or more screws 83. Through this arrangement, a thoroughly stable solid load sustaining desk assembly is attained, and if it is desired to disassembly the desk that can be readily accomplished by detaching the modlar units from one another.

It will be appreciated that although the cable compartment module 15 has been illustrated as at the back of a knee space at the left side of the desk 10 and the compartment module 17 at the right side of the desk, those positions may, if preferred, be switched. If preferred, either of the modules 15 or 17 may be used independently on a desk arrangement that does not require the other of the modules. Further, if preferred, a plurality of generally similar modules according to the module 15, or according to the module 17 may be used with one desk. Where only one of either the module 15 or the module 17 is needed on a desk the desk top may be shorter and the module connected to and between the opposite standards 14. Either of the modules 15 or 17 may be extended to a greater width where employed independently or where a larger such module is required in a module desk construction. Thus it will be appreciated that this modular desk construction affords numerous practical options as to size and capacity. The prefabricated modules lend themselves to satisfying various requirements and preferences.

As well illustrated schematically in FIG. 2 the compartment modules 15 provides an efficient and convenient cable compartment within which not only can electrical connections be effected with various electronic equipment, but the cables are effectively housed. By way of example, a power cable 84 is adapted to be lead into the compartment module 15 through an opening 85 in the rear edge of the adjacent standard 14 and then from within the standard through aligned openings 87 in the inner wall of the standard and the contiguous wall 59 of the module 15 into the compartment within the module 15 and electrically connected to the outlets 69. Electrical connections by means of cables 88 with the electronic devices 11 are effected by extending the cables through suitable holes 89 in the top panel 13 and leading into the compartment within the module 15 where the cables are electrically plugged into suitable ones of the outlets 69. For electrical connection of the console represented by the chassis 70, one or more electrical cables 90 plugged into suitable of the outlets 69 extend through aligned openings 91 in the contiguous walls 59 and 71 of the modules 15 and 17 and are connected to the console within the compartment of the module 17. Therefore it will be clear that the module 15 provides a convenient and efficient cable compartment, and passages provide for wiring connection with equipment in adjacent compartments or on the top of the desk. Convenient concealed outlets 69 are provided for connection of the various cables to the power outlets in the cable module 15. Extra electrical components for future service needs may be stored in extra space in the compartment module 15 as well as in either or both of the compartmented standards 14. At least one of the standards 14 may be provided with rack means 92 therein, for operator manual, instruction book, paper supply, etc., storage. Modifications and changes in electronic equipment can be easily and readily made. Easy access into all compartments is provided for.

It will be understood that variations and modifications may be effected without departing from the spirit and scope of the novel concepts of this invention.

I claim as my invention:

1. A modular electronic desk assembly, comprising: a load supporting top structure comprising a frame unit of substantial length and width and having structural members for supporting a generally horizontal working area top panel firmly against sagging under load;

pylons each comprising an enclosed compartment and being for upright disposition in supporting relation under each end portion of the frame unit and with each of said pylons having a removable door which doors face in opposite directions away from one another;

an electrical equipment compartment supported on said frame unit beneath said top panel between said pylons, a cable compartment carried by said frame unit beneath and in abutment with said frame unit and having a cable compartment opening and said electrical equipment compartment having an opening interfacing with said cable compartment opening to allow the passage of electrical wiring, the cable compartment further having at least one opening in interfacing communication with an opening in at least one of said pylons for extension of wiring from the cable compartment into the pylon, and a hole in said at least one pylon to extend the electrical wiring exteriorly of the same for connection with an electrical outlet.

2. A modular desk construction according to claim 1, wherein said frame unit comprises longitudinally extending front and rear top panel supporting bars, and transverse frame bars having means for securing the top panel to the frame unit.

3. A construction according to claim 2, wherein said transverse bars have flanges for supporting a top panel load.

4. A construction according to claim 1, including a top panel in combinaton therewith, and means for detachably securing the top panel to the frame unit.

5. A construction according to claim 1, wherein at least one of said pylons is hollow whereby to provide said substantial compartment therein, and latching means for securing said door over said opening to provide a closure.

6. A construction according to claim 5, wherein each of said pylons has a horizontal base bar, and leveler foot means carried by said base bar.

7. A construction according to claim 1, wherein said frame unit has stepped seating flanges at its opposite ends, said seating flanges being engageable in stable assembled relation with top surfaces of the pylons.

8. A construction according to claim 1, including means for securing the electrical equipment compartment to said frame unit and to at least one of said pylons.

9. The desk assembly of claim 1 further characterized by a generally horizontal working area top panel being mounted and supported on said frame unit and overlying said cable compartment and with said electrical equipment compartment being from said frame unit and being covered by said top panel.

10. The desk assembly of claim 1 further characterized by a hole extending through said relatively thin generally horizontal working area top panel having a lower end in communication with said cable compartment for extension of wiring from topside of the top panel into the cable compartment.

11. A modular electronic desk assembly, the combination comprising: a load supporting top structure comprising an open frame unit of substantial length and width and having longitudinal and transverse structural members for supporting a generally horizontal working area top panel firmly against sagging under load;

pylons each comprising an enclosed hollow compartment and being for upright disposition in supporting relation under each end portion of the frame unit and with each of said pylons having a removable door which doors face in opposite directions away from one another.

a cable compartment carried by said frame unit beneath and in abutment with said frame unit between the pylons and having a cable compartment opening, the cable compartment further having at least one opening in interfacing communication with an opening in interfacing communication with an opening in at least one of said pylons for extension of wiring from the cable compartment into the pylon, and a hole in said at least one pylon to extend the electrical wiring exteriorly of the same for connection with an electrical outlet;

a module is hung from said frame unit between said pylons to one side of said cable compartment, means for securing one side of the module to the hollow pylon, and openings in the pylon and the module providing for passage of cables for effecting electrical connections with electronic equipment supported by the desk construction.

12. An assembly according to claim 11, including a top panel mounted on top of said frame unit and cable passage through said panel to the interior of said compartment module.

13. An assembly according to claim 12, including a second compartment module, and means for securing the second module in suspended relation under said top panel contiguous to said first mentioned module.

14. A construction according to claim 13, including means for securing said modules to one another and to said pylons whereby to effect a rigid stable integrated assembly of the top structure, the pylons, and the modules.

15. An assembly according to claim 12, wherein said top panel has rabbet groove seats at is oppsite end portions, and said pylons have upper ends complementary to said seats for reception in said seats in stable connected relation.

* * * * *